US006255766B1

(12) United States Patent
Park et al.

(10) Patent No.: US 6,255,766 B1
(45) Date of Patent: Jul. 3, 2001

(54) CATHODE RAY TUBE WITH CONVEX INTERIOR WALLS FOR ADDED STABILITY

(75) Inventors: Won-sueg Park; Do-nyun Kim, both of Kyungki-do (KR)

(73) Assignee: Samsung Display Devices, Co., LTD, Kyungki-Do (KR)

( * ) Notice: Subject to any disclaimer, the term of this patent is extended or adjusted under 35 U.S.C. 154(b) by 0 days.

(21) Appl. No.: 09/248,398

(22) Filed: Feb. 10, 1999

(30) Foreign Application Priority Data

Sep. 19, 1998 (KR) ..... 98-38812

(51) Int. Cl.[7] ..... H01J 9/02
(52) U.S. Cl. ..... 313/408; 445/30
(58) Field of Search ..... 313/408, 461, 313/477 R, 440, 403, 434

(56) References Cited

U.S. PATENT DOCUMENTS 3,731,129 5/1973 Tsuneta et al. ..... 313/64
5,929,559 * 7/1999 Sano et al. ..... 313/477 R

FOREIGN PATENT DOCUMENTS 10-154472 6/1998 (JP) .

* cited by examiner

*Primary Examiner*—Vip Patel
*Assistant Examiner*—Ken A Berck
(74) *Attorney, Agent, or Firm*—Christie, Parker & Hale, LLP

(57) ABSTRACT

A cathode ray tube includes a rectangular panel on which a phosphor screen is formed, a cylindrical neck in which an electron gun is disposed, and a funnel formed contiguous to the panel. The funnel includes a cone part whose interior surface has a circular section at the position contiguous to the neck. The circular section is deformed from the neck side to the panel side to have a non-circular section having a maximum diameter along a direction other than the horizontal and vertical axis, and distances from a funnel axis to interior surface of the cone part are non-linearly increases or decreases, and the vertical interior surface is convexed to the funnel axis with fulfilling the following condition, $$\Delta H/rd<0.16$$

where rd represents a distance from the funnel axis to the interior surface of the funnel at the diagonal direction, and ΔH represents a distance from a vertical line which connects the neighboring two corner points formed at the convexed interior surface to the top of the convexed interior surface.

18 Claims, 4 Drawing Sheets

CATHODE RAY TUBE WITH CONVEX INTERIOR WALLS FOR ADDED STABILITY

BACKGROUND OF THE INVENTION (a) Field of the Invention

The present invention relates to a cathode ray tube (CRT) and more particularly, to a cathode ray tube capable of effectively deflecting electron beams and having increased strength against external stress.

(b) Description of the Related Art

A CRT is a device for displaying images on a screen by vertically and horizontally deflecting electron beams generated from an electron gun and landing the deflected electron beams onto the phosphor layers formed on the screen. The deflection of the electron beam is controlled by a deflection yoke which is mounted on an exterior surface of a funnel of the CRT and forms vertical and horizontal magnetic fields. CRTs are generally employed for color televisions(TVs), monitors and high definition televisions(HDTV). And with the increasing use of the CRTs, there is a need to reduce the length of the CRT for increasing the brightness of the displayed image and for reducing the size of the final products, such as TVs, monitors and HDTVs.

In a CRT with reduced length, the electron beams should be deflected with wider-angles, and the deflection frequency and current supplied to the deflection yoke should be increased for the wider-angle deflections of the electron beams. As the deflection frequency and current increase, the deflection magnetic fields tend to leak to the outside of the cathode ray tube and the power consumption increases.

In order to decrease the magnetic field leakage, a compensation coil is generally mounted with the deflection yoke. When, however, the compensation coil is employed, the power consumption of the cathode ray tube further increases. Alternatively, in order to decrease the deflection power and the magnetic field leakage, it is conventionally preferable to decrease the neck diameter of the cathode ray tube and the outer diameter of the funnel near the neck side on which the deflection yoke is mounted, so that the deflection field effectively acts on the electron beams. When the neck diameter simply decreases, there are disadvantages that the resolution of the image deteriorates due to the reduced diameter of the electron gun, and the outer electron beams are likely to bombard the inner wall of the funnel, and thus not properly land on the phosphor layer of the screen.

In order to solve these problems, U.S. Pat. No. 3,731,129 discloses a funnel having a wider peripheral portion sealed to the periphery of the panel, and a deflection portion whose cross-sectional configuration gradually varies from a shape, substantially similar to that of the rectangular image produced on the panel, to a circular shape. Thereby, the vertical and horizontal coils of the deflection yoke are closely located to the passage of the electron beams, and deflect the electron beams with reduced deflection power and without the electron beams bombarding the inner wall of the funnel.

However, in U.S. Pat. No. 3,731,129, the configuration of interior surface of the funnel was not considered in designing the funnel having the rectangular cross section. Therefore, the electron beams are not effectively deflected, and the strength of the funnel against external pressure is not satisfactory.

To overcame the shortcoming, Japanese Laid-Open patent 10-154472 discloses the funnel of a cathode ray tube having a cross-section shown in FIG. 8. As shown in FIG. 8, the funnel yoke part 22 has a maximum diameter along a direction other than the horizontal axis(X) and the vertical axis(Y), for example, a rectangular section. In FIG. 8, the Pi(θ) represents a point at which the interior surface of the yoke part 22 and a linear line drawn from the tube axis with an angle θ are met. The Piv(θ) and Pih(θ) represent distances from the point Pi(θ) to the horizontal axis(X) and the vertical axis(Y), respectively. As shown in FIG. 8, the interior surface of the yoke part 22 is designed so that the Piv(θ) and Pih(θ) are functions of θ which non-linearly increase or decrease. Therefore, the Piv(θ) and Pih(θ) change with at least one maximum value, and therefore the interior surface of the yoke part 22 can be convexed to the tube axis. However, the Japanese Laid-Open patent 10-154472 designs the interior surface of the yoke without considering the strength of the cathode ray tube against the external pressure and the trajectories of the electron beams. Therefore, it is required to develop the optimum configuration of the interior surface for increasing the strength of the cathode ray tube and effective deflection of the electron beams.

SUMMARY OF THE INVENTION

The present invention is directed to a cathode ray tube which substantially obviates the limitations and disadvantages of the related art.

An object of the present invention is to provide a cathode ray tube capable of effectively deflecting electron beams, and thereby reducing the deflection power consumption and having increased strength against external stress.

Another object of the present invention is to provide a cathode ray tube particularly suitable for flat-panel cathode ray tube.

To accomplish these and other advantages, the cathode ray tube according to the present invention is comprised of a rectangular panel on which a phosphor screen is formed, a cylindrical neck in which an electron gun is disposed, and a funnel formed contiguous to the panel. The funnel includes a cone part whose interior surface has a circular section at the position contiguous to the neck. The circular section is changed from the neck side to the panel side to have a non-circular section having a maximum diameter along a direction other than the horizontal and vertical axis, and perpendicular distances from a funnel axis to interior surface of the cone part are non-monotonously or non-linearly increases or decreases, and the vertical interior surface is convexed to the funnel axis with meeting the following condition, $$\Delta H/rd<0.16$$

where rd represents a distance from the funnel axis to the interior surface of the funnel at the diagonal direction, and AH represents a distance from a vertical line which connects the neighboring two corner points formed at the convexed interior surface to the top of the convexed interior surface.

In addition, the horizontal interior surface can be convexed to the funnel axis with fulfilling the following condition, $$\Delta V/rd<0.34$$

where ΔV represents a distance from a horizontal line which connects the neighboring two corner points formed at the convexed interior surface to the top of the convexed interior surface.

The objectives and other advantages of the invention will be realized and attained by the structure particularly pointed out in the written description and claims as well as the appended drawings.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

DETAILED DESCRIPTION OF THE INVENTION

Description will now be made in detail as to the preferred embodiments of the present invention with the accompanying drawings.

Figure 1:
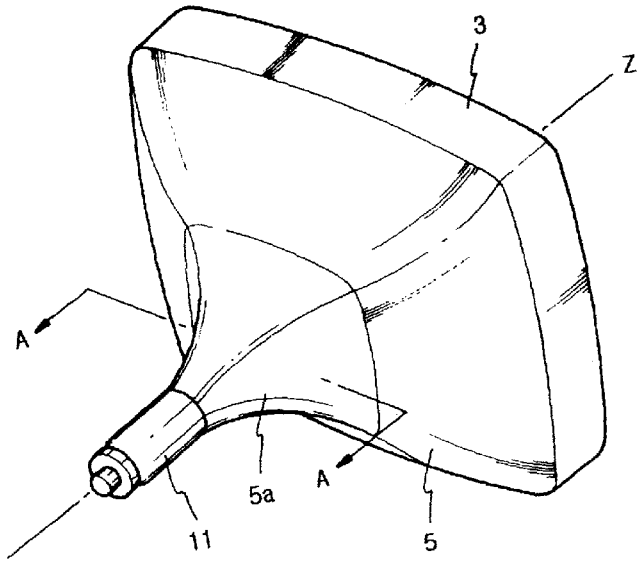
FIG. 1 is a perspective view of a cathode ray tube according to an embodiment of the present invention.
Figure 2:
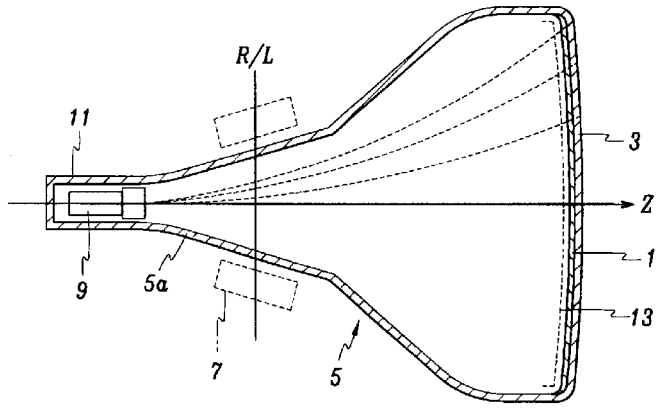
FIG. 2 is a sectional view of a cathode ray tube according to an embodiment of the present invention, taken along a diagonal line of a panel of the cathode ray tube.

As shown in FIGS. 1 and 2, a cathode ray tube is formed with a substantially rectangular panel 3, a funnel 5 formed contiguous to the panel 3, and a cylindrical neck 11 formed contiguous to the small-diameter end portion of the funnel 5. A phosphor screen 1 is formed on the inner surface of the panel 3, and a deflection yoke 7 is mounted on a cone part 5*a* of the funnel 5. An electron gun assembly 9 for emitting three electron beams is disposed in the neck 11. The three electron beams emitted from the electron gun assembly 9 are deflected by horizontal and vertical deflection fields generated by the deflection yoke 7 to the horizontal and the vertical directions of the panel 3, respectively. The deflected electron beams reach the phosphor screen 1 through a shadow mask 13 mounted on the inner surface of the panel 3, and cause the phosphor to emit colored light.

Figure 3:
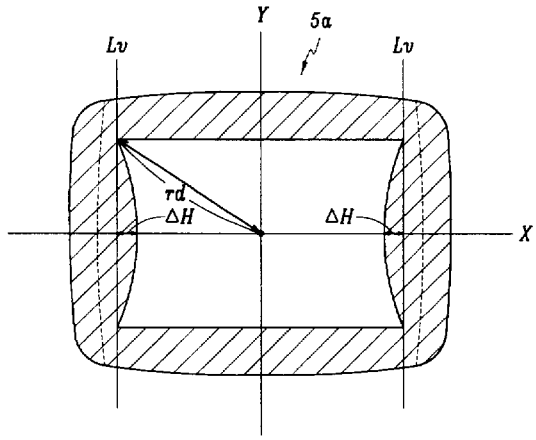
FIG. 3 is a sectional view of a cathode ray tube according to an embodiment of the present invention, taken along the line A—A of FIG. 1.

In order to reduce the deflection power consumption and increase resistance of the cathode ray tube against external stress, the cathode ray tube is formed as follows. The exterior surface of the cone part 5*a* has a circular cross section at the position near the neck 11, and the circular section is gradually deformed from the neck side to the panel side to have a non-circular section having a maximum diameter along a direction other than the horizontal and vertical axis, for example, a rectangular section. Thus, a sectional view of the cathode ray tube taken along the line A—A of FIG. 1 is shown as FIG. 3, and the section of the cone part 5*a* from a reference line(R/L) to a panel-side end portion of the cone part 5*a* also has the substantially rectangular shape as shown in FIG. 3.

The reference line (R/L) is defined by elongating the trajectories of the outer electron beams which are escaped from the effect of the deflection yoke 7, and by calculating the crossing point of the elongated trajectories. Thus, the reference line formed at the middle and center portion of the cone part 5*a*.

The interior surface of the cone part 5*a* also has a circular section at the position near the neck 11, and the circular section is gradually changed from the neck side to the panel side to have a non-circular section having a maximum diameter along a direction other than the horizontal and vertical axis. And the distances from the tube axis to interior surface of the cone part 5*a* are non-linearly increases or decreases. The vertical interior surface is convexed to the tube axis with fulfilling the following condition.

$$\Delta H/rd<0.16$$

where rd represents a distance from the tube axis(Z) to the interior surface of the funnel at the diagonal direction, and ΔH represents a distance from a vertical line Lv which connects the neighboring two corner points formed at the convexed interior surface to the top of the convexed interior surface.

The configuration of the interior surface of the present invention is determined and optimized to increase the strength of the CRT, beam-shadow-neck (BSN) characteristics of the electron beams, and to decrease the deflection power. Therefore, the deflection power is reduced by changing the shape of the cone part 5*a*, and the strength of the cathode ray tube maximized by optimally convexing the interior surface of the cone part 5*a*.

The interior surface of the cone part 5*a* is preferably formed so that the value of the ΔH/rd gradually increases as the rd increases. Namely, the ΔH/rd preferably has the minimum value at the neck side, and has the maximum value at the position which is closest to the panel. More preferably, the value of the ΔH/rd gradually increases with bigger slope after the reference line than before the reference line, and the interior surface of the cone part are symmetrically convexed along a line by which ΔH is defined.

Figure 4:
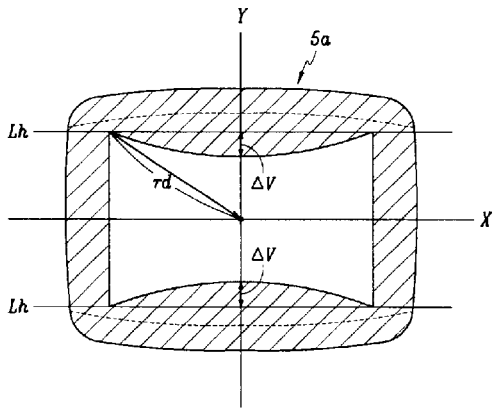
FIG. 4 is a sectional view of a cathode ray tube according to other embodiment of the present invention.
Figure 5:
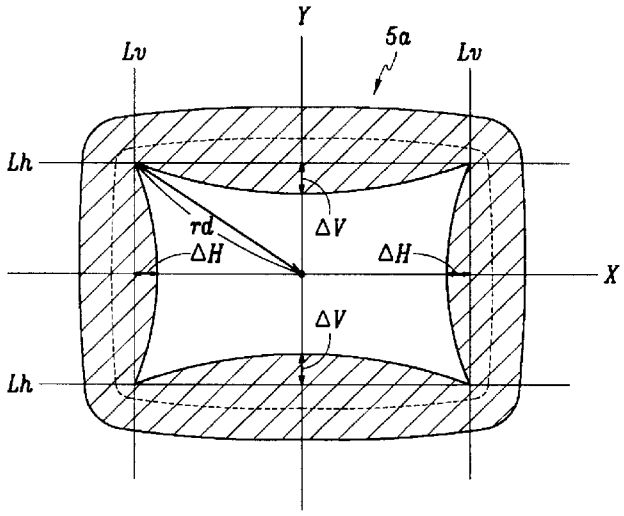
FIG. 5 is a sectional view of a cathode ray tube according to another embodiment of the present invention.

The configuration of the interior surface also can be formed on the horizontal surface as shown in FIG. 4, and preferably can be formed on the both vertical and horizontal surfaces as shown in FIG. 5.

As shown in FIG. 4, the exterior surface of the cone part 5*a* has a circular section at the position near the neck 11, and the circular section is gradually deformed from the neck side to the panel side to have a non-circular section, and the horizontal interior surface is convexed with fulfilling the following condition.

$$\Delta V/rd<0.34$$

where rd represents a distance from the tube axis (Z) to the interior surface of the funnel at the diagonal direction, and ΔV represents a minimum distance from a horizontal line Lh which connects the neighboring two corner points formed at the convexed interior surface to the top of the convexed interior surface.

More preferably, the vertical and the horizontal interior surfaces of the cone part 5*a* are both convexed with fulfilling the above-described conditions. With this configuration, the deflection power is more effectively reduced, and the strength of the cathode ray tube increases.

The tensile stresses on the cathode ray tube are tested with varying the ΔH/rd and ΔV/rd, and the test results are shown in the following tables 1 and 2.

TABLE 1

| ΔH / rd | Tensile strength |
|---|---|
| 0 | 100% |
| 0.05 | 94.5% |
| 0.1 | 88.2% |
| 0.16 | 82.1% |

| ΔV / rd | Tensile strength |
|---|---|
| 0 | 100% |
| 0.1 | 93.1% |
| 0.2 | 83.9% |
| 0.34 | 72.8% |

Figure 6:
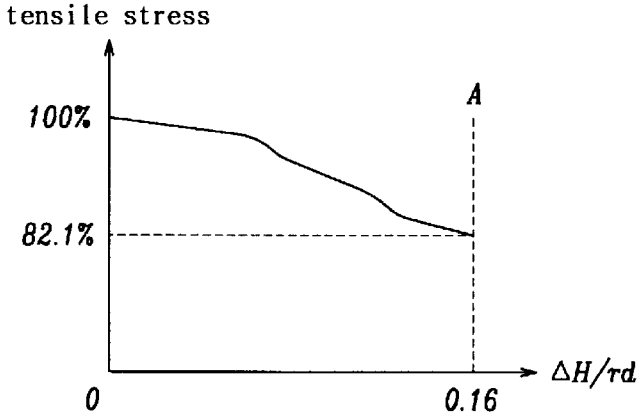
FIGS. 6 and 7 are graphs showing the relations between the tensile stresses and interior surface configurations of the cathode ray tube according to the embodiments of the present invention.
Figure 7:
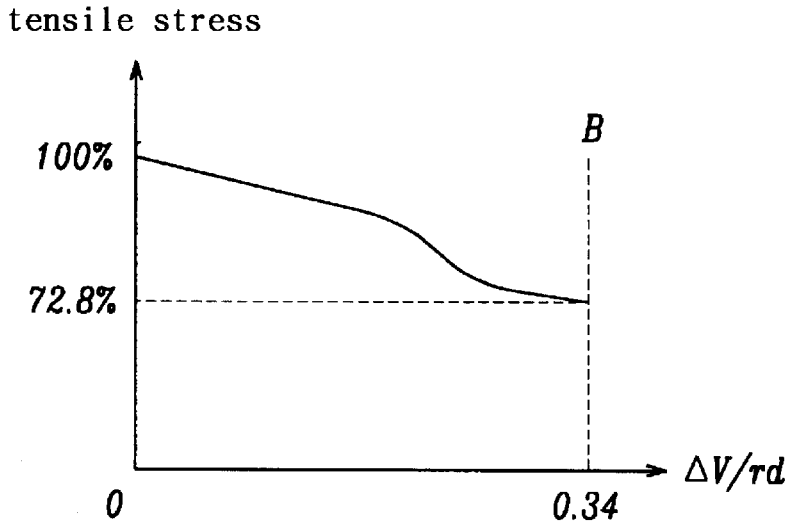
Figure 8:
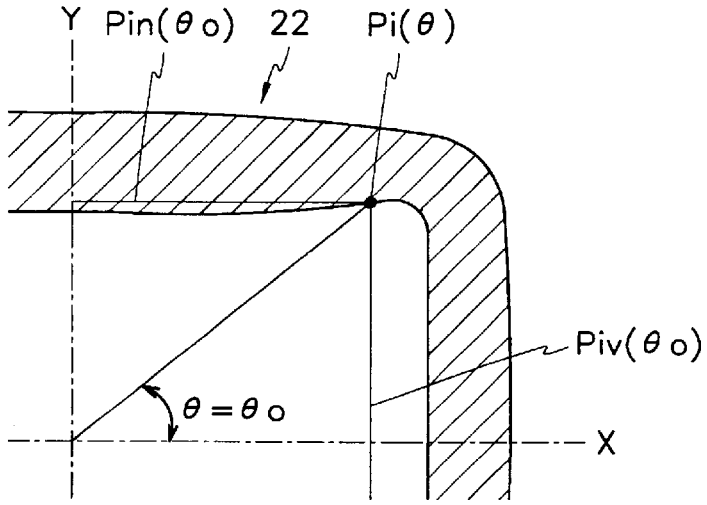
FIG. 8 is a partial sectional view of a conventional funnel yoke part taken along the vertical line to the tube axis.

FIGS. 6 and 7 are graphs showing the relations between the tensile stresses and interior surface configurations of the cathode ray tube according to the test results in tables 1 and 2. The lines A and B in FIGS. 6 and 7 represent the optimum values of the ΔH/rd and ΔV/rd at which the electron beams do not bombard the interior surface of the cone part 5*a*, and the strength of the cathode ray tube maximized.

By configuring the interior surface of the cone part according to the present invention, the strength of the cathode ray tube increases. Thus, the width of the glass cone part 5*a* can be reduced to be smaller, as shown in the dashed lines in FIGS. 3, 4 and 5.

The concept of the present invention can be applied for cone parts having sections of various polygon shapes, and it will be apparent to those skilled in the art that various modifications and variations can be made in the present invention without departing from the spirit or scope of the invention. This application is based on application No. 98-38812 filed in Korean Industrial Property Office on Sep. 19, 1998, the content of which is incorporated herein by reference.

What is claimed is:

1. A cathode ray tube comprising:

a rectangular panel on which a phosphor screen is formed;

a cylindrical neck in which an electron gun is disposed; and funnel formed contiguous to the panel, wherein the funnel includes a cone part whose interior surface has a circular section at the position contiguous to the neck, and the circular section is deformed from the neck side to the panel side to have a non-circular section having a maximum diameter along a direction other than the horizontal and vertical axis, and distances from a funnel axis to interior surface of the cone part are non-linearly increased or decreased, and the vertical interior surface is convexed to the funnel axis with fulfilling the following condition, $$0<\Delta H/rd<0.16$$

where rd represents a distance from the funnel axis to the interior surface of the funnel in the diagonal direction, and ΔH represents a distance from a vertical line which connects the neighboring two corner points formed at the convexed interior surface to the top of the convexed interior surface.

2. The cathode ray tube of claim 1, wherein the ΔH/rd increases as the rd increases.

3. The cathode ray tube of claim 1, wherein the interior surface of the cone part are symmetrically convexed along a line by which ΔH is defined.

4. A cathode ray tube comprising:

a rectangular panel on which a phosphor screen is formed;

a cylindrical neck in which an electron gun is disposed; and a funnel formed contiguous to the panel, wherein the funnel includes a cone part whose interior surface has a circular section at the position contiguous to the neck, and the circular section is deformed from the neck side to the panel side to have a non-circular section having a maximum diameter along a direction other than the horizontal and vertical axes, and distances from a funnel axis to the interior surface of the cone part are non-linearly increased or decreased, and the horizontal interior surface is convexed to the funnel axis with fulfilling the following condition, $$0<\Delta V/rd<0.34$$

where rd represents a distance from the funnel axis to the interior surface of the funnel in the diagonal direction, and ΔV represents a distance from a horizontal line which connects the neighboring two corner points formed at the convexed interior surface to the top of the convexed interior surface.

5. The cathode ray tube of claim 4, wherein the ΔV/rd increases as the rd increases.

6. The cathode ray tube of claim 4, wherein the interior surface of the cone part is symmetrically convexed along a line by which ΔV is defined.

7. A cathode ray tube comprising:

a rectangular panel on which a phosphor screen is formed;

a cylindrical neck in which an electron gun is disposed; and a funnel formed contiguous to the panel, wherein the funnel includes a cone part whose interior surface has a circular section at the position contiguous to the neck, and the circular section is deformed from the neck side to the panel side to have a non-circular section having a maximum diameter along a direction other than the horizontal and vertical axes, and distances from a funnel axis to the interior surface of the cone part are non-linearly increased or decreased, and the vertical interior surface is convexed to the funnel axis with fulfilling the following condition, $$0<\Delta H/rd<0.16$$

where rd represents a distance from the funnel axis to the interior surface of the funnel in the diagonal direction, and ΔH represents a distance from a vertical line which connects the neighboring two corner points formed at the convexed interior surface to the top of the convexed interior surface, and the horizontal interior surface is convexed to the funnel axis with fulfilling the following condition, $$0<\Delta V/rd<0.34$$

where ΔV represents a distance from the horizontal line which connects the neighboring two corner points formed at the convexed interior surface to the top of the convexed interior surface.

8. The cathode ray tube of claim 1, wherein the ΔH/rd and the ΔV/rd increase as the rd increases.

9. The cathode ray tube of claim 1, wherein the interior surfaces of the cone part are symmetrically convexed along lines by which ΔH or ΔV is defined.

10. A cathode ray tube comprising:

a rectangular panel having a phosphor screen;

a cylindrical neck having an electron gun disposed therein; and a funnel having an end contiguous to the panel, and an opposite end contiguous to the neck, the funnel including a cone part comprising an interior surface having a circular cross-section at a position contiguous to the neck, and a non-circular cross-section away from the neck toward the panel, said non-circular cross-section having a maximum diameter along a direction other than a horizontal or a vertical axis of the non-circular cross-section and a convex vertical interior surface with $$0<\Delta H/rd<0.16$$

where rd is a distance from a funnel axis extending between the neck and the panel to the interior surface of the non-circular cross-section of the funnel in a diagonal direction, and ΔH is a distance from a vertical line connecting two neighboring vertices of the interior surface of the non-circular cross-section to a plateau of the convexed interior surface.

11. The cathode ray tube of claim 10 wherein the ΔH/rd increases as the rd increases.

12. The cathode ray tube of claim 10 wherein the convex interior surface of the cone part is symmetrical with respect to a line extending through ΔH.

13. A cathode ray tube comprising:

a rectangular panel having a phosphor screen;

a cylindrical neck having an electron gun disposed therein; and a funnel having an end contiguous to the panel, and an opposite end contiguous to the neck, the funnel including a cone part comprising an interior surface having a circular cross-section at a position contiguous to the neck, and a non-circular cross-section away from the neck toward the panel, said non-circular cross-section having a maximum diameter along a direction other than a horizontal or a vertical axis of the non-circular cross-section and a convex horizontal interior surface with $$0<\Delta V/rd<0.34$$

where rd is a distance from a funnel axis extending between the neck and the panel to the interior surface of the non-circular cross-section of the funnel in a diagonal direction, and ΔV is a distance from a horizontal line connecting two neighboring vertices of the interior surface of the non-circular cross-section to a plateau of the convexed interior surface.

14. The cathode ray tube of claim 13 wherein the ΔV/rd increases as the rd increases.

15. The cathode ray tube of claim 13 wherein the convex interior surface of the cone part is symmetric with respect to a line extending through ΔV.

16. A cathode ray tube comprising:

a rectangular panel having a phosphor screen;

a cylindrical neck having an electron gun disposed therein; and a funnel having an end contiguous to the panel, and an opposite end contiguous to the neck, the funnel including a cone part comprising an interior surface having a circular cross-section at a position contiguous to the neck, and a non-circular cross-section away from the neck toward the panel, said non-circular cross-section having a maximum diameter along a direction other than a horizontal or a vertical axis of the non-circular cross-section, a convex vertical interior surface with $$0<\Delta H/rd<0.16$$

where rd is a distance from a funnel axis extending between the neck and the panel to the interior surface of the non-circular cross-section of the funnel in a diagonal direction, and ΔH is a distance from a vertical line connecting two neighboring vertices of the interior surface of the non-circular cross-section to a plateau of the convexed interior surface, and a convex horizontal interior surface with $$0<\Delta V/rd<0.34$$

where ΔV is a distance from a horizontal line connecting two neighboring vertices of the interior surface of the non-circular cross-section to a plateau of the convexed interior surface.

17. The cathode ray tube of claim 16 wherein the ΔH/rd and the ΔV/rd increase as the rd increases.

18. The cathode ray tube of claim 16 wherein the convex interior surfaces of the cone part are symmetric with respect to both a line extending through ΔH and a line extending through ΔV.

* * * * *